US010837248B2

(12) United States Patent
Hattenbach et al.

(10) Patent No.: US 10,837,248 B2
(45) Date of Patent: Nov. 17, 2020

(54) METHOD AND APPARATUS FOR A CHEMICAL CAPSULE JOINT

(71) Applicant: SKY BUCK TECHNOLOGY LLC, Midland, TX (US)

(72) Inventors: Dustin James Hattenbach, Midland, TX (US); Jerry Don Gathings, Odessa, TX (US)

(73) Assignee: Skye Buck Technology, LLC., Midland, TX (US)

( * ) Notice: Subject to any disclaimer, the term of this patent is extended or adjusted under 35 U.S.C. 154(b) by 0 days.

(21) Appl. No.: 16/394,562

(22) Filed: Apr. 25, 2019

(65) Prior Publication Data

US 2020/0115980 A1 Apr. 16, 2020

Related U.S. Application Data

(60) Provisional application No. 62/662,572, filed on Apr. 25, 2018.

(51) Int. Cl.
*E21B 27/02* (2006.01)

(52) U.S. Cl.
CPC ..... *E21B 27/02* (2013.01)

(58) Field of Classification Search
CPC ..... E21B 27/02
USPC ..... 166/376
See application file for complete search history.

(56) References Cited

U.S. PATENT DOCUMENTS

| | | | | |
|---|---|---|---|---|
| 4,611,664 | A * | 9/1986 | Osterhoudt, III | C09K 8/536 166/162 |
| 4,790,386 | A * | 12/1988 | Johnson | E21B 27/02 166/117 |
| 5,054,557 | A | 10/1991 | Wittrisch | |
| 5,249,629 | A | 10/1993 | Jennings | |
| 5,566,772 | A | 10/1996 | Coone et al. | |
| 6,223,823 | B1 | 5/2001 | Head | |
| 6,386,288 | B1 | 5/2002 | Snider et al. | |
| 6,962,202 | B2 | 11/2005 | Bell et al. | |
| 7,322,416 | B2 | 1/2008 | Burris, II et al. | |
| 9,129,728 | B2 | 9/2015 | Edbury et al. | |
| 9,500,057 | B2 | 11/2016 | Al-Rabeh | |
| 9,593,552 | B2 | 3/2017 | Aines et al. | |
| 2005/0167104 | A1* | 8/2005 | Roddy | C04B 40/0641 166/279 |
| 2011/0100634 | A1* | 5/2011 | Williamson | C09K 8/03 166/310 |
| 2013/0112410 | A1* | 5/2013 | Szarka | E21B 33/16 166/289 |
| 2015/0101803 | A1 | 4/2015 | Kriesels | |

* cited by examiner

*Primary Examiner* — Taras P Bemko
(74) *Attorney, Agent, or Firm* — G. Michael Roebuck

(57) ABSTRACT

A chemical capsule joint having a chemical capsule filled with a chemical that is to be released into a casing string to which the chemical capsule joint is deployed in a wellbore after an end of the chemical capsule joint if drilled up. The chemical capsule joint allows continuation of cementing operation until an end of the chemical capsule joint is drilled up to release the chemical from the chemical capsule in the chemical capsule joint. The chemical is then freed from the chemical capsule and allowed to leach into production fluids in the casing string to which the chemical capsule joint is deployed in a well bore.

19 Claims, 13 Drawing Sheets

METHOD AND APPARATUS FOR A CHEMICAL CAPSULE JOINT

CROSS REFERENCE TO RELATED APPLICATIONS

This patent application is based on U.S. Provisional Patent Application Ser. No. 62/662,572 by Hattenbach entitled "A Method and System for a Chemical Capsule Joint" filed on 25 Apr. 2018, which is hereby incorporated herein by reference in its entirety.

BACKGROUND OF THE INVENTION

There s a need for well treatment solutions that increase productivity of a wellbore during production.

FIELD OF THE INVENTION invention relates to dispensing well treatment solutions that increase productivity of a wellbore and prolong production life.

BRIEF DESCRIPTION OF THE DRAWINGS

The invention will be better understood in reference to the following drawings, which are examples of an illustrative embodiment and are not limiting as different embodiments of the invention may be realized.

SUMMARY OF THE INVENTION

A chemical capsule joint deployed down hole and filled with a chemical sealed in an annulus of the chemical capsule joint, wherein the seal is drilled up and the chemical is released into production fluids in the wellbore in which the chemical capsule joint is deployed. The chemical capsule joint allows continuation of cementing operations through an interior tube until an insert sealing chemicals in the chemical capsule joint is drilled out to release the chemicals into production fluids in the wellbore, in which the chemical capsule joint is deployed.

DETAILED DESCRIPTION OF THE INVENTION

A chemical capsule joint is provided to release a chemical stored inside of the chemical capsule joint into production fluids in a wellbore in which the chemical capsule joint is deployed after an insert seal on to the chemical capsule joint is drilled up. After the insert seal is drilled up, the chemical from the chemical capsule joint is released into production fluids in the wellbore in which the chemical capsule joint is deployed. After an upper aluminum insert seal and composite tubing incorporated into the chemical capsule joint are drilled up, a chemical stored in the chemical capsule joint, the wellbore fluids flow into the chemical stored in the chemical capsule joint, and the chemical is freed to release into production fluids in the wellbore. The chemical stored in the chemical capsule joint mixes with the production fluids and substantially reduces corrosion and damage to production equipment and fractures in the wellbore and enhances production. In a particular illustrative embodiment of the invention the composite tubing is made of fiber glass.

Figure 1:
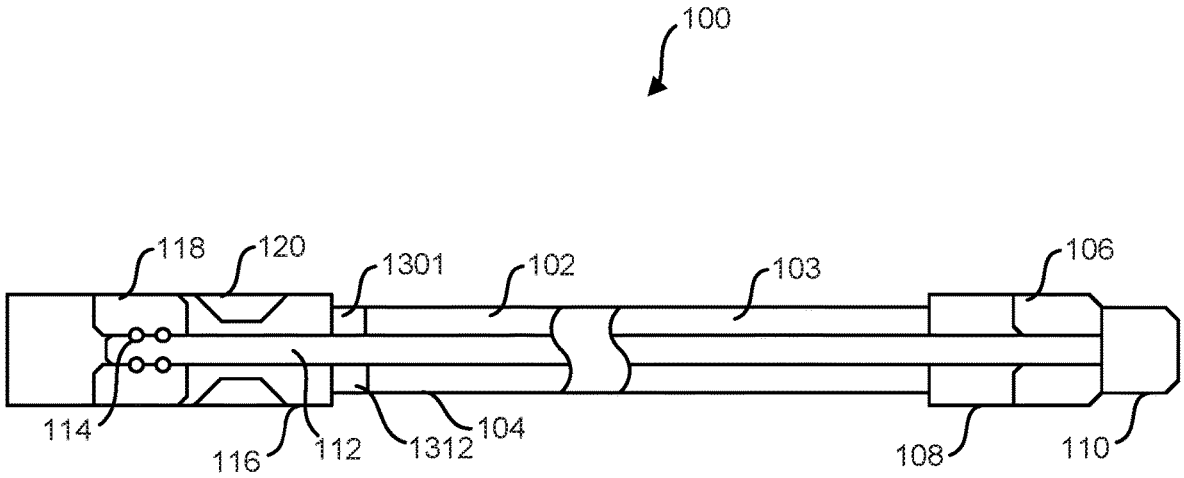
FIG. 1 is a side view of a schematic depiction of a chemical capsule joint for coupled applications in a particular illustrative embodiment of the invention.
Figure 7:
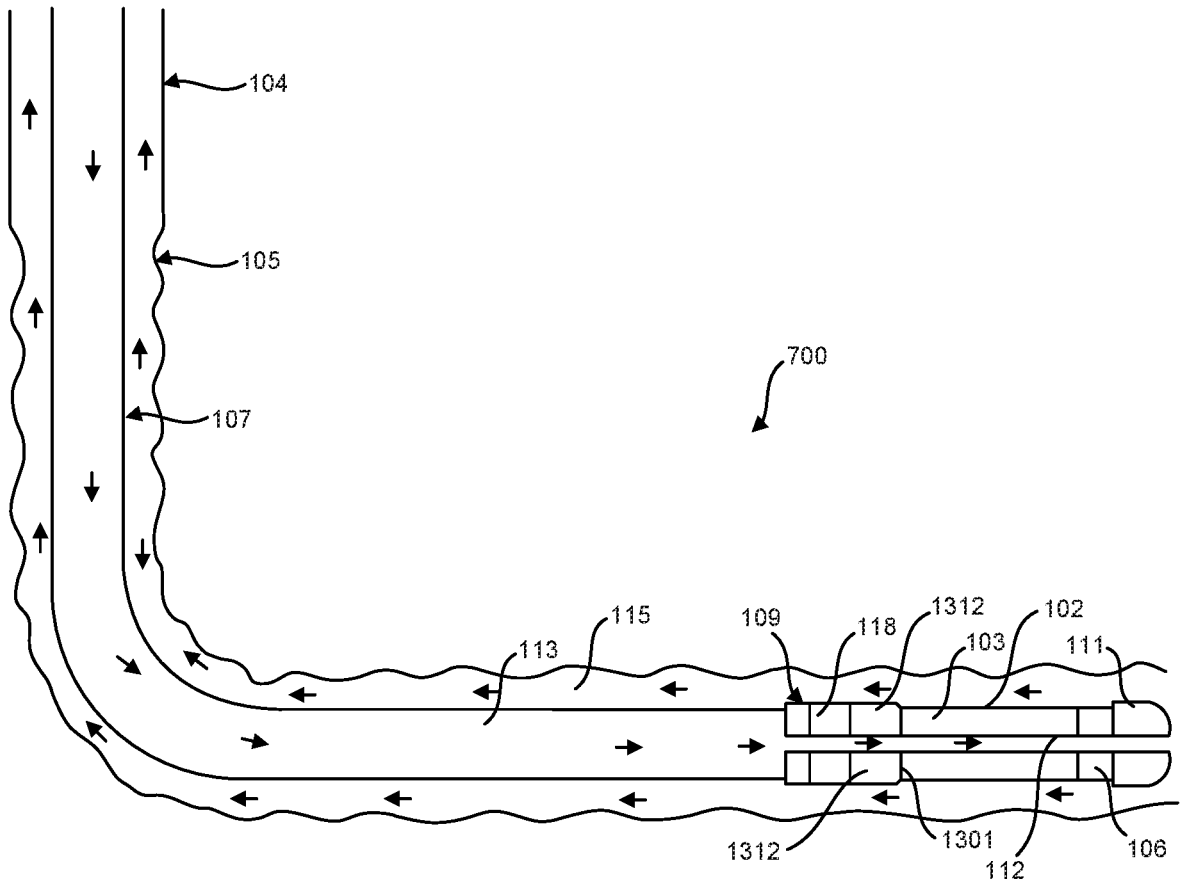
FIG. 7 is a side view of a schematic depiction of a chemical capsule joint during operation in a wellbore after the chemical capsule joint has been deployed and the in a particular illustrative embodiment of the invention.

FIG. 1 is a side view of a schematic depiction of a chemical capsule joint 100 in a particular illustrative embodiment of the invention showing a cutaway view for coupled applications using the chemical capsule joint at the toe of the casing. During drilling and casing a horizontal well, a majority of production casing strings deployed in a horizontal well are provided with a float shoe 111 and a float collar 109 (as shown in FIG. 7 discussed below), in the production casing string 107. As shown in FIG. 7, In a particular illustrative embodiment of the invention, a chemical capsule joint 100 is placed in between the float shoe and float collar in place of what would typically have been one or two joints of casing in the casing string. As shown in FIG. 1, In a particular illustrative embodiment of the invention, the chemical capsule joint 100 is a full-length joint (for example, a 47 foot to 52 foot length) of casing. An annular cavity within chemical capsule joint, also referred to as a chemical capsule is formed in an annular space 102 in the chemical capsule joint is filled with a chemical 103 that is to be released into production fluids in the wellbore in which the chemical capsule joint is deployed after a threaded aluminum insert 118 seal on the top end of the chemical capsule joint is drilled up. In a particular illustrative embodiment of the invention, an 1.875 inch internal diameter composite tube 112 that runs through the center of the chemical capsule joint is provided that allows fluids such as liquid cement to pass through the chemical capsule joint through the composite tube, thus allowing normal cementing operations to occur after the chemical capsule joint has been deployed on the casing string on which the chemical capsule joint has been deployed in a well bore. The internal composite tubing string allows liquid cement to flow through the internal composite tubing string inside of the chemical capsule joint and into the borehole in which the casing string is deployed and into the annular space 115 between the casing string and bore hole interior wall 105. The aluminum insert 118 at the top of the chemical capsule joint which seals the chemicals inside of the chemical capsule, is subsequently drilled out to expose a plurality of longitudinal holes drilled in a top end of the chemical capsule and allows a chemical stored in the chemical capsule in the chemical capsule joint to flow out of the holes and into the production fluids in the casing string in which the chemical capsule joint is deployed in a well bore from the lower end or toe of a casing string. This annulus 102 forming the chemical capsule is then filled with a slow releasing chemical to combat (corrosion, scale, paraffin, or bacteria) in the casing string to which the chemical capsule joint is deployed in a borehole. In another particular embodiment of the invention, slow releasing chemical pellets are stored in the chemical capsule, wherein the slow releasing round chemical pellets have an initial outside diameter that is larger than an initial inside diameter of the holes drilled in the top of the chemical capsule so that the round chemical pellets do not pass through the holes and exit the chemical capsule and the production fluids enter the chemical capsule through the holes to intermingle with the chemical pellets and release the chemicals into the well bore above the chemical capsule joint.

As shown in FIG. 1, in a particular illustrative embodiment of the invention, the chemical capsule joint 100 includes but is not limited to a threaded aluminum insert seal 118 (that is later drilled up to release the chemical into the wellbore) with a smooth bore receptacle and a 4.500 inch steel no go pad 120 to prevent the chemicals in the chemical capsule joint from being drilled up, a chemical capsule 102 containing the chemicals 103, a steel threaded receiver 106 for the composite inside tube 112, an O-ring seal 114 between the threaded aluminum insert 118 and the composite tube 112, a 6.050 inch box connection 116 for the joining with the casing and the 1.875 inch internal diameter composite inside tube 112, a 42 foot section of 5.5 inch 17 pound per foot P110 casing 104, a 6.050 inch box connection 108 for the casing and 5.5 inch casing pin 110.

After completion of the well, and during the drilling out of plugs in the wellbore, the operator drills through the float collar 109 (if ran) and into the top of the chemical capsule joint, through the aluminum insert 118 and down to the no go plates 120. The drill (drill bit) is stopped by the 4.5" ID steel no go plates 120 provided at the top end of the chemical capsule joint. Drilling out the aluminum insert on the chemical capsule joint allows the production fluids to flow through holes 1301 and into the top of the chemical capsule, shown in FIG. 13 and to mix with the chemical 103 stored in the chemical capsule joint 102. The chemicals then mix with production fluids in the casing string to release the mixture of production fluids and chemicals into in the casing string in which the chemical capsule joint is deployed. The fluid mixture of production fluids and chemicals from the chemical capsule then travels through the casing string and to surface thereby treating the well, which helps to prevent costly equipment failures. The chemical mixed with the production fluids also helps to keep perforations formed in the casing in the borehole clean and enhance production of hydrocarbons from the fractures in the wellbore.

The chemical capsule joint does not interfere with typical tools such as floatation subs, stage tools, and kick start/toe valves. The present invention enables chemicals to be released, into the production casing at the bottom of the drill string in which the chemical capsule joint is deployed in a well bore.

The chemical capsule joint deploys the chemical sealed inside of the chemical capsule in the chemical capsule joint at the toe of the casing string, that is, at the distal end or bottom end of the casing string down hole, which provides the entirety of the casing string in which the chemical capsule joint is deployed at the end of the casing string to be treated by the chemical released into the in the casing string in which the chemical capsule joint is deployed, after the aluminum insert is drilled up. The chemical capsule joint provides a substantial volume of chemicals to be released in a casing string. For a chemical capsule joint that is 47 feet long, a length of the chemical capsule joint, using a 5½-inch 20# with an inner tube that's 2⅜-inch outside diameter, provides approximately 7,609 cubic inches of volume space for chemical storage inside the chemical capsule in the chemical capsule joint. Depending on the grade of casing this number can be slightly less. The chemical capsule joint replaces an already planned joint of casing. In another particular embodiment, multiple joints of casing are connected together to form the chemical capsule joint to increase the area for chemical storage in of the annulus inside of the chemical capsule joint.

Figure 2:
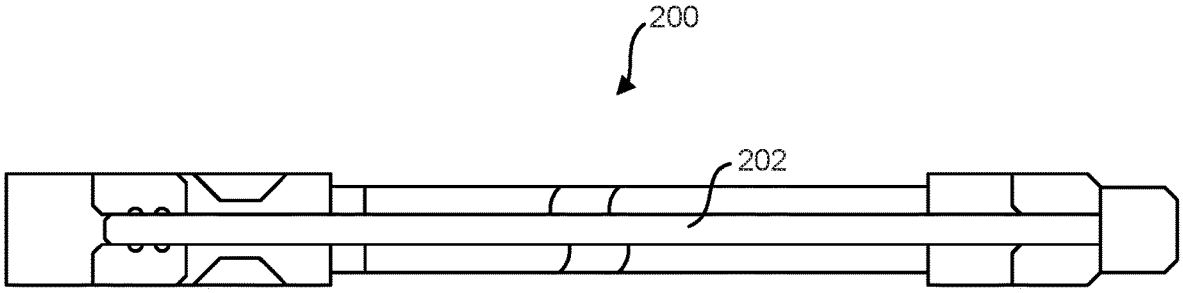
FIG. 2 is a cutaway view of a schematic depiction of a chemical capsule joint in a particular illustrative embodiment of the invention showing the chemical capsule joint during pumping a primary cement job.

FIG. 2 is a cutaway view of a schematic depiction of a chemical capsule joint in a particular illustrative embodiment of the invention showing the chemical capsule joint during pumping on a primary cement job. The cement 202 passes through the interior composite tube 112 that passes through the center of the chemical capsule joint, so that cementing operations can continue uninterrupted after the chemical capsule joint is deployed on a casing string.

Figure 3:
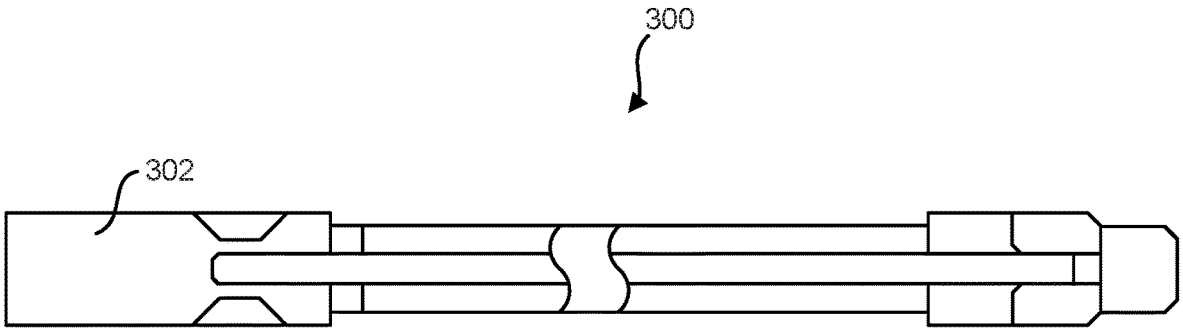
FIG. 3 is a cutaway view of a schematic depiction of a chemical capsule joint in a particular illustrative embodiment of the invention showing the chemical capsule joint during production in a post completion wellbore job and an aluminum insert on a chemical capsule joint being drilled up to allow a chemical stored in an annulus of the chemical capsule joint to be released into the wellbore fluids during production.

FIG. 3 is a cutaway view of a schematic depiction of a chemical capsule joint in a particular illustrative embodiment of the invention showing tool producing post completion job and aluminum insert having been being drilled up 302 post completion.

Figure 4:
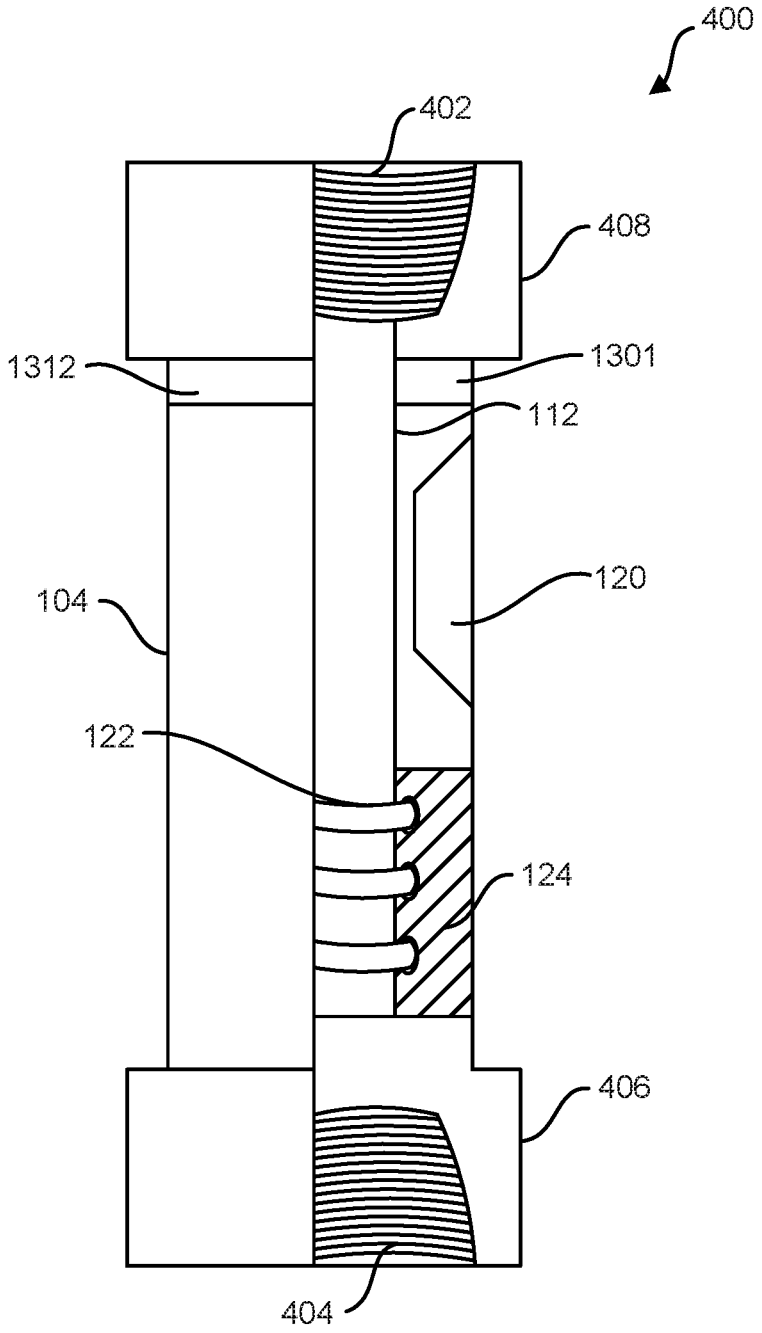
FIG. 4 is a side view of a schematic depiction of a chemical capsule joint in a particular illustrative embodiment of the invention showing an aluminum inner composite tubing receiver that receives an inner composite tubing that allows cement to flow through the chemical capsule joint during primary cementing operations.

Turning now to FIG. 4, FIG. 4 is a side view of a schematic depiction of a chemical capsule joint 400 in a particular illustrative embodiment of the invention. As shown in FIG. 4, a top 406 and bottom 408 of a chemical capsule joint 102 are shown. Threads 402 are provided to receive and affix a threaded casing to the bottom 408 of the chemical capsule joint. Threads 404 are provided to receive and affix a threaded casing or float collar to the top 406 of the chemical capsule joint. An inner 2⅜-inch outside diameter composite tube 112 is shown. In a particular illustrative embodiment of the invention, pair of 1" thick no-go plates 120 are provided only on two sides of the casing and not the entire circumference of the casing. In another particular illustrative embodiment of the invention, 1" thick no-go plates 120 are provided only on two sides of the casing and go around the entire circumference of the casing. An aluminum inner composite tubing receiver 124 is shown, the inner composite tubing receiver being 1.5-inch thick, having 3 O-rings 122 that fit into O-ring slots that are formed in the aluminum inner composite tubing receiver on the top end of chemical capsule joint. The aluminum inner composite tubing receiver 124 is drillable and wraps around entire inside circumference of the casing. In a particular embodiment of the invention, a top end 117 of the composite tube protrudes from the top end of the chemical capsule is made of a material that is drillable so that the composite tube does not stop the drilling out of the aluminum insert and the composite tube is drilled out with the aluminum insert.

Figure 5A:
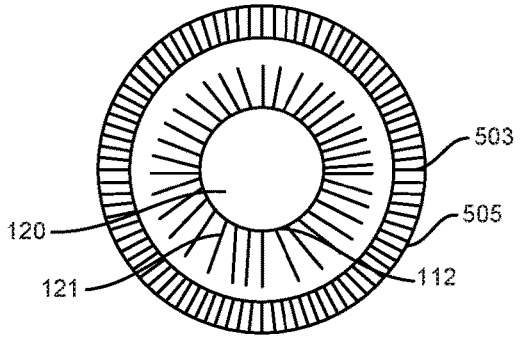
FIG. 5A and FIG. 5B are top views of a schematic depiction of a chemical capsule joint in a particular illustrative embodiment of the invention.
Figure 5B:
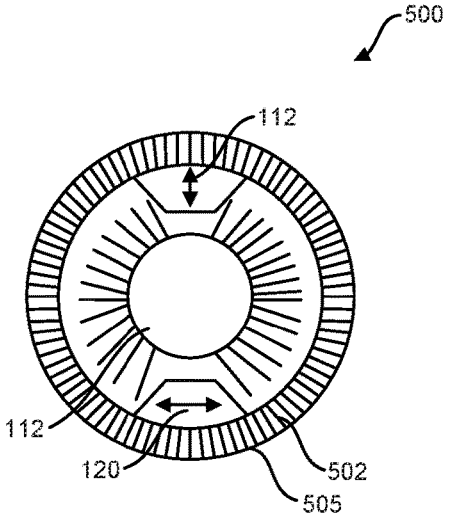

Turning now to FIG. 5A and FIG. 5B FIG. 5A is a top view of a schematic depiction of a particular illustrative embodiment of the invention, a cross section 502 of the top FIG. 5A and cross section 503 of bottom FIG. 5B of a chemical capsule joint in a particular illustrative embodiment of the invention. As shown in the top cross-sectional view FIG. 5A, a casing collar 505, a 2⅜-inch inner composite tubing 112 and 1-inch thick no-go plates 120 approximately 2 inches wide are provided. As shown in the bottom cross-section the casing collar 505 FIG. 5B, a 2⅜-inch inner composite tubular 120 and an aluminum inner composite tubular receiver 121 are provided.

Figure 6:
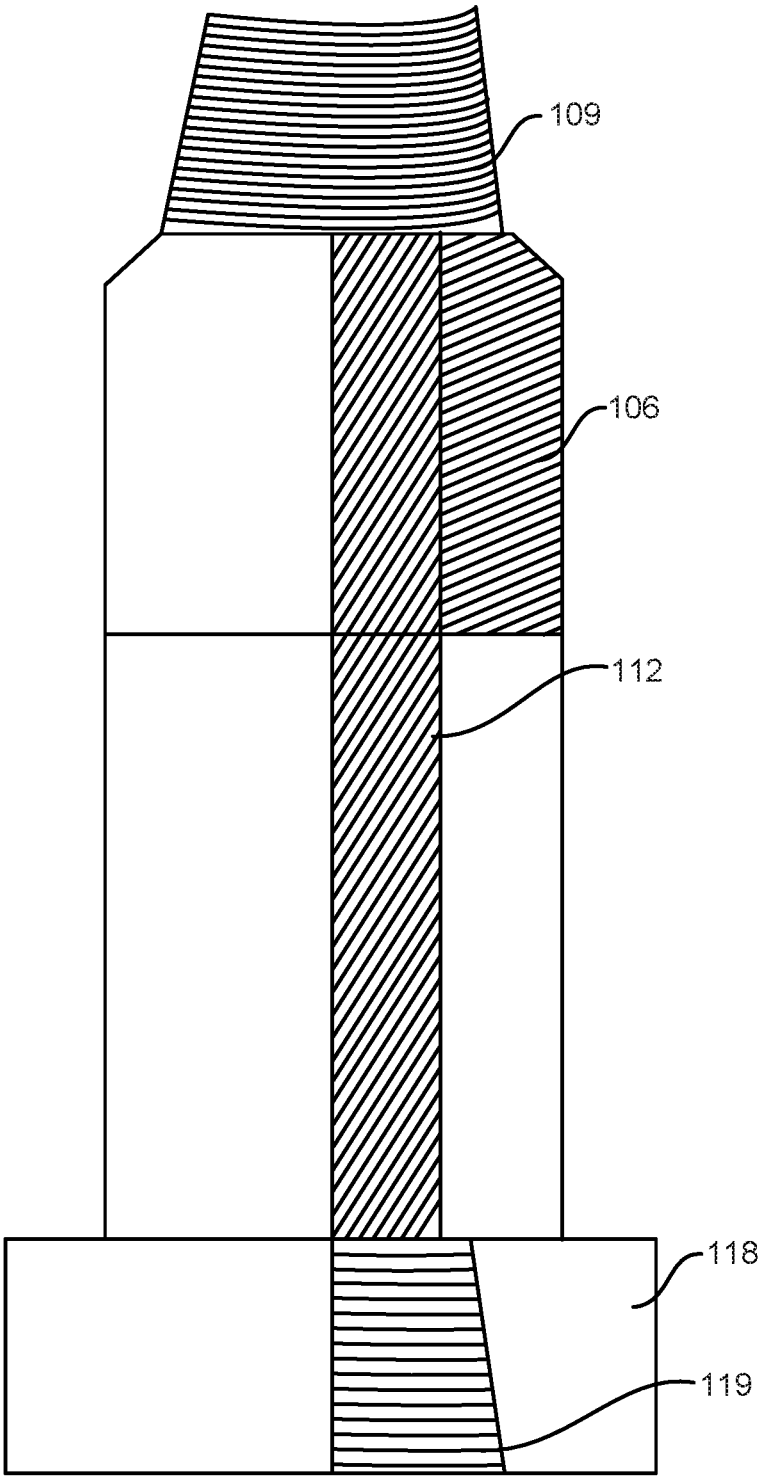
FIG. 6 is a side view of a schematic depiction of a chemical capsule joint in a particular illustrative embodiment of the invention.

Turning now to FIG. 6, FIG. 6 is a side view of a schematic depiction of a chemical capsule joint in a particular illustrative embodiment of the invention. As shown in FIG. 6, a bottom 5½ inch casing pin 109, a steel threaded receiver 106 for 2⅜-inch inner tube 112 are shown.

Turning now to FIG. 7, FIG. 7 is a side view of a schematic depiction 700 of a particular illustrative embodiment of a chemical capsule joint 102 deployed downhole in operation in a wellbore 105 open hole in a particular illustrative embodiment of the invention. As shown in FIG. 7, the chemical capsule joint 102 is deployed at the bottom end of a casing string 107 between a float collar 109 and float shoe 111. An annular space 103 forming a chemical capsule in the chemical capsule joint containing the chemicals is shown. Drilling mud 113 flows through the casing 113, into and through the inner tube 112 and through the chemical capsule joint 102 and returns 115 to the surface in the well bore 105 open hole. The chemicals remain sealed inside of the chemical capsule and are not released until after the aluminum insert seal on the chemical capsule is drilled up.

Figure 8:
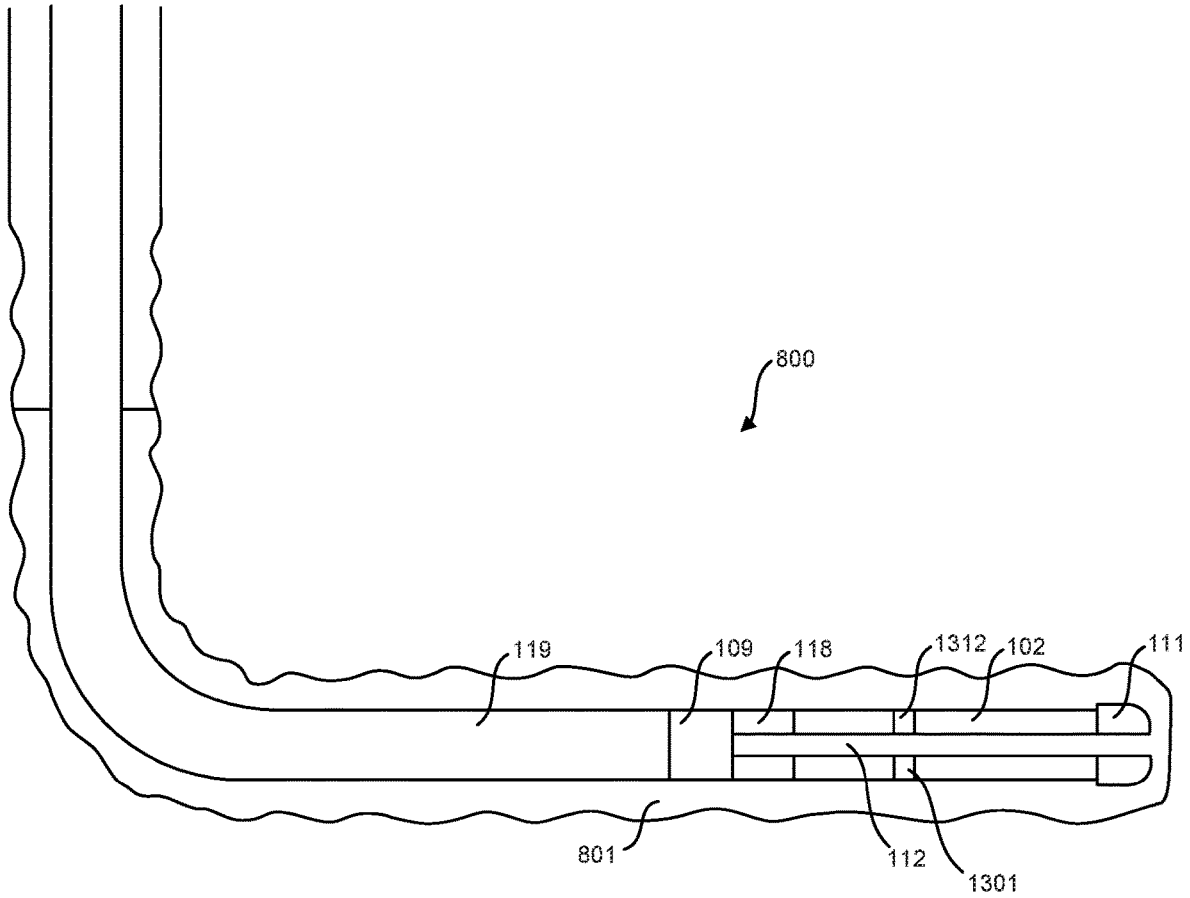
FIG. 8 is a side view of a schematic depiction of a chemical capsule joint after cementing is completed in a particular illustrative embodiment of the invention.

Turning now to FIG. 8, FIG. 8 is a side view of a schematic depiction of 800 of a particular illustrative embodiment of a chemical capsule joint after cementing is completed in a particular illustrative embodiment of the invention. As shown in FIG. 8, cement 801 that has been pumped through the casing 113, into the inner tube 112 and through the chemical capsule joint 102 tool is followed by water 119 and a cement wiper plug 121.

Figure 9:
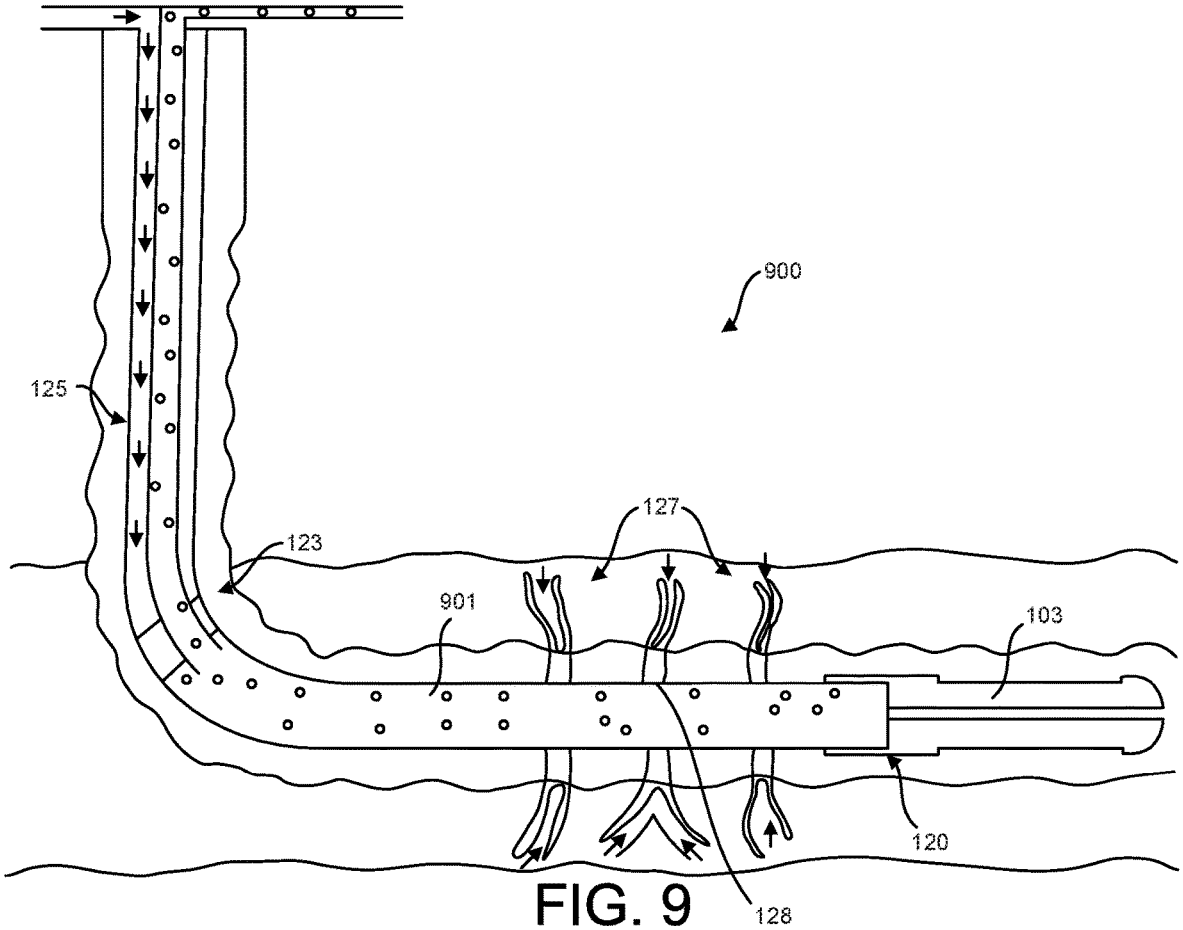
FIG. 9 is a side view of a schematic depiction of a chemical capsule join releasing chemicals into production fluids in a particular illustrative embodiment of the invention.

Turning now to FIG. 9, FIG. 9 is a side view of a schematic depiction 900 of a particular illustrative embodiment of the invention, in which a chemical capsule joint, is shown releasing chemicals 901 from the chemical capsule 103. The chemicals are mixed with production fluids and forms a mixture 901 that mixes into the production fluids in a particular illustrative embodiment of the invention. The operator drills though the wiper plug that was shown installed in FIG. 8 and the aluminum insert seal 118 on the chemical capsule joint to allow the chemicals from inside of the chemical capsule in the chemical capsule joint to leach into production fluids in the casing and to mix with the production fluids and form a mixture 901 of chemicals and production fluids. The mixture chemicals with the production fluids cleans the casing string and wellbore along with perforations 128 and fractures 127 in the wellbore and casing into the formation surrounding the casing string.

Figure 10:
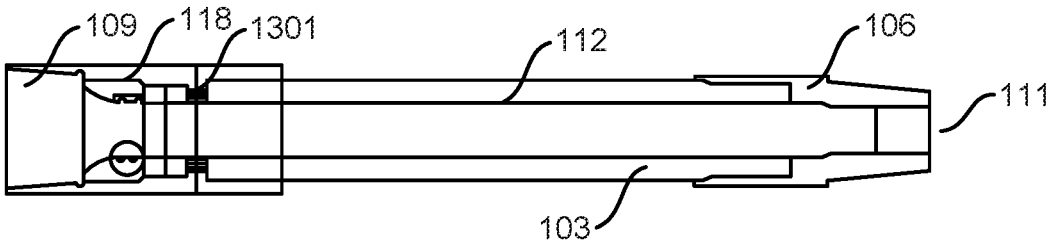
FIG. 10 depicts a particular illustrative embodiment of the invention, showing a tool when it is first run in the hole with production casing string.

Turning now to FIG. 10, in a particular illustrative embodiment of the invention, as shown in FIG. 10, a chemical capsule joint is shown after it has first been run into the hole with production casing string and has been placed between a float shoe and a float collar. The region 103 represents the chemical in the annular space between the internal diameter of the casing and the outside diameter of the inner tubular 112.

Figure 11:
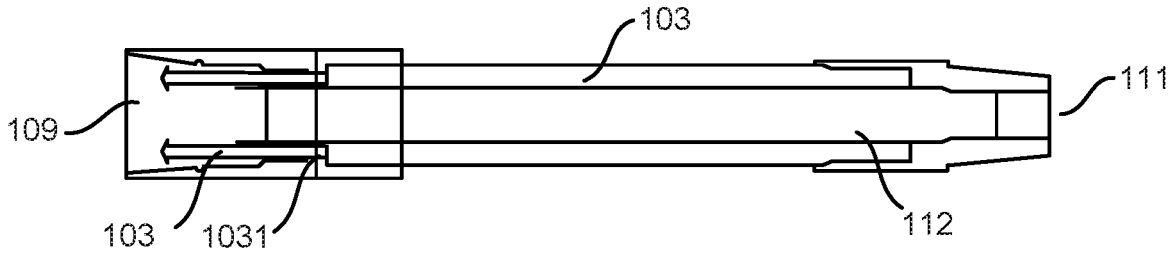
FIG. 11 depicts a particular illustrative embodiment of the invention, showing a tool after the well has been completed and plugs, float collar, and aluminum insert have been drilled out and the chemical is introduced into wellbore fluids and released into the wellbore through holes in the chemical capsule joint.

Turning now to FIG. 11, in a particular illustrative embodiment of the invention, as shown in FIG. 11, showing a chemical capsule joint after the well has been completed and the plugs, float collar, and aluminum insert seal have been drilled out. After the aluminum insert seal is drilled out and exposes the holes 1301 (also depicted in FIG. 13) in the chemical capsule joint that allows fluid access to the chemicals inside of the chemical capsule. The chemical from inside the chemical capsule is introduced to wellbore fluids and slowly released into the well through the holes 1301 in the chemical capsule in the chemical capsule joint. In a particular embodiment of the invention the chemical is in liquid form in the chemical capsule joint and flows through the holes 1301 (shown in FIG. 13) formed in the chemical capsule that are exposed to the borehole fluids when the aluminum insert seal is drilled out. In another particular embodiment of the invention the chemical is in small pellet form that are smaller in diameter than the holes 1301 and that flows through the holes 1301 (shown in FIG. 13) formed in the chemical capsule that are exposed to the borehole fluids when the aluminum insert is drilled out. In another particular embodiment, the round pellets are of varying diameter so that the smaller diameter pellets dissolves to a size that passes through the holes faster than the larger diameter pellets dissolves to a size that passes through the holes.

Figure 12:
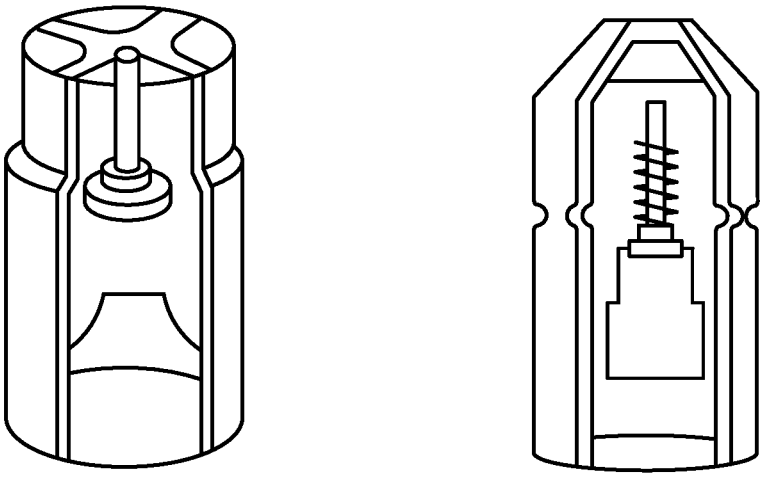
FIG. 12 depicts an illustrative embodiment of the invention showing a float collar and a float shoe are depicted that are provided in a particular illustrative embodiment.

Turning now to FIG. 12, as shown in FIG. 12 a float collar and a float shoe are depicted that are provided in a particular illustrative embodiment. Suitable float collars and float shoes are widely available commercially.

Figures 13, 13A:
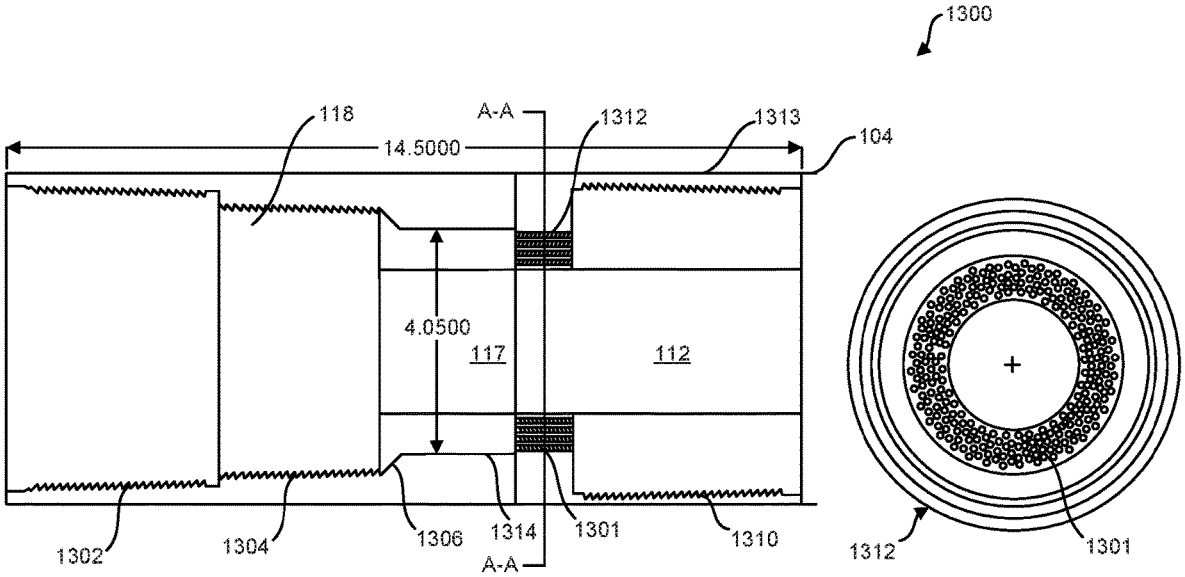
FIG. 13 and FIG. 13A depict a side view of a particular illustrative embodiment of the invention.

In a particular embodiment of the invention, the chemical capsule joint is made up of three pieces that are assembled on each end of a section of casing as shown in FIG. 1. A top end 1300 of the chemical capsule joint is shown in FIG. 13 and FIG. 13A. A section of casing 104 is screwed into the top of the chemical capsule joint into threads 1310. The aluminum insert seal 118 screws into top of the chemical capsule joint at threads 1304. The bottom of the chemical capsule joint 106 screws onto the other end of the section of casing 104 at threads 1402. Turning now to FIGS. 13 and 13A, as shown in FIGS. 13 and 13A a side view of a particular illustrative embodiment of the invention is depicted. In a particular embodiment of the invention the chemical is in liquid form in the chemical capsule joint and flows through the holes 1301 (shown in FIGS. 13 and 13A) in 1-inch wide annular section 1312 formed in the chemical capsule that are exposed to the borehole fluids when the aluminum insert seal is drilled out. In a particular illustrative embodiment of the invention, the annular section 1312 is metal. The annular section surrounds the interior tube 112 and the holes 1301 in the annular section are positioned adjacent the chemical capsule allow the chemicals stored in the chemical capsule to mix through the holes with production fluids. In another particular embodiment of the invention the chemical is in small pellet form that are smaller in diameter than the holes 1301 and that flows through the holes 1301 (shown in FIGS. 13 and 13A) formed in the chemical capsule that are exposed to the borehole fluids when the aluminum insert is drilled out. The composite interior tubing 112 extends through the center of the top 1300 of the chemical capsule joint.

Figure 14:
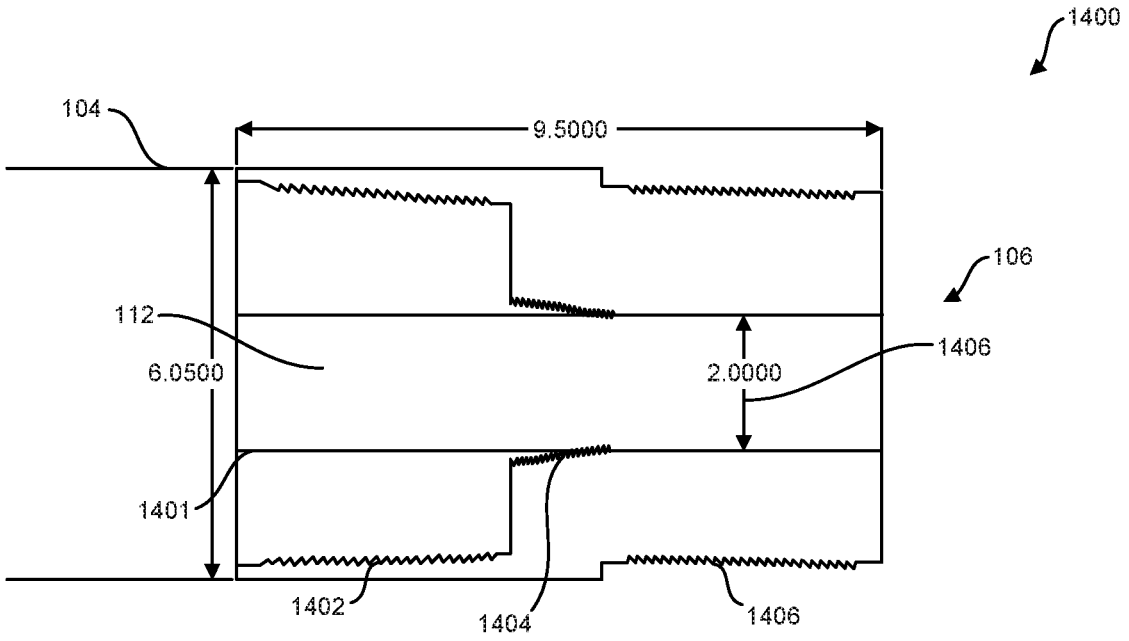
FIG. 14 depicts a side view of a particular illustrative embodiment of the invention.

Turning now to FIG. 14, as shown in FIG. 14, a side view of a particular illustrative embodiment of the invention is depicted. As shown in FIG. 14, in a particular illustrative embodiment, a bottom 1400 of the chemical capsule joint in threads 1402 is depicted. The casing 104 screws into the bottom 1400 of the chemical capsule joint and into bottom 106. The composite interior tubing 112 extends through the center of the bottom 106 of the chemical capsule joint.

Figure 15:
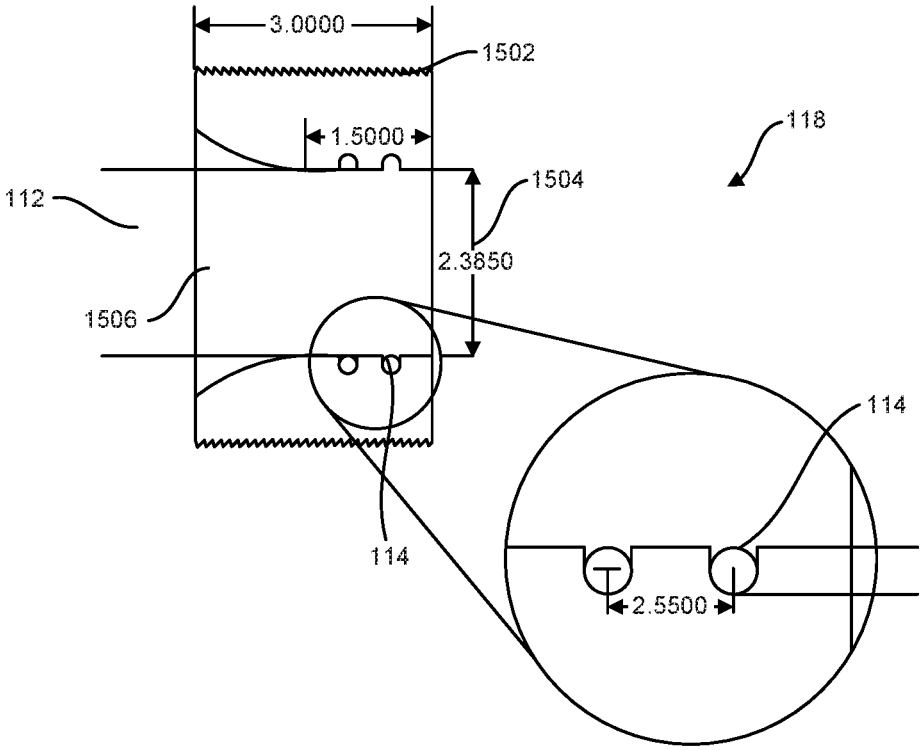
FIG. 15 depicts a side view of a particular illustrative embodiment of the invention.

Turning now to FIG. 15, as shown in FIG. 15, a side view of a particular illustrative embodiment of the invention is depicted. In a particular illustrative embodiment of the invention, the drillable aluminum insert seal 118 is depicted. The drillable aluminum insert seal 118 screws into threads 1404 and receives the composite interior tubing 112 and is sealed by O-rings 114.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, various features are grouped together in a single embodiment for streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A chemical capsule joint, the chemical capsule joint comprising:

a section of casing;

an interior tube though the center of the section of casing;

a chemical capsule storage space formed in the annulus formed between an interior surface of the section of casing and an outside surface of the interior tube;

a drillable insert seal surrounding the top end of the interior tubing, wherein the drillable insert seal seals in a chemical stored in the chemical capsule; and an annular section adjacent the chemical capsule wherein holes are drilled in the annular section so that production fluids come in contact with the chemical stored in the chemical capsule after the drillable insert seal is drilled out.

2. The chemical capsule joint of claim 1, wherein a top portion of the interior tubing passes through the drillable insert seal and is drilled out with the drillable insert seal.

3. The chemical capsule joint of claim 1, further comprising:

a stop plate at the top of the chemical capsule joint that contacts a drill and stopping drilling of the chemical capsule joint when the drill contacts the stop plate.

4. The chemical capsule joint of claim 3, wherein the stop plate is a pair of 2" steel tabs on the interior of the chemical capsule joint.

5. The chemical capsule joint of claim 3, wherein the stop plate is circular steel ring on the interior of the chemical capsule joint.

6. The chemical capsule joint of claim 1, wherein the chemical is a plurality of chemical pellets.

7. The chemical capsule joint of claim 6, wherein the chemical pellets have a diameter larger than an interior diameter of the holes.

8. The chemical capsule joint of claim 7, wherein the chemical pellets are of two different diameters, a larger and smaller diameter, wherein the smaller diameter pellets dissolve to a smaller diameter size that is smaller than the interior diameter of the holes and pass through holes faster than the larger diameter pellets.

9. The chemical capsule joint of claim 8, wherein the smaller diameter pellets have a different chemical composition than the larger diameter pellets.

10. The chemical capsule joint of claim 8, wherein the smaller diameter pellets have a different chemical concentration than the larger diameter pellets.

11. A method for treating a well bore, the method comprising:

deploying a section of casing on a bottom end of the casing string;

allowing passage of fluids through an interior tube though the center of the section of casing;

drilling out a drillable insert seal surrounding the top end of the interior tubing, wherein the drillable insert seal seals in a chemical stored in the chemical capsule; and releasing chemicals from a chemical capsule storage space formed in the annulus formed between an interior surface of the section of casing and an outside surface of the interior tube.

12. The method of claim 11, wherein the chemicals are release through an annular section adjacent the chemical capsule wherein holes are drilled in the annular section so that production fluids come in contact with the chemical stored in the chemical capsule after the drillable insert seal is drilled out.

13. The method of claim 11, wherein a top portion of the interior tubing passes through the drillable insert seal and is drilled out with the drillable insert seal.

14. The method of claim 11, further comprising:

stopping the drilling out of the drillable insert seal with a stop plate at the top of the chemical capsule joint that contacts a drill and stops the drilling of the chemical capsule joint when a drill drilling out the drillable insert seal contacts the stop plate.

15. The method of claim 14, wherein the stop plate is a pair of 2" steel tabs on the interior of the chemical capsule joint.

16. The method of claim 14, wherein the stop plate is circular steel ring on the interior of the chemical capsule joint.

17. The method of claim 11, wherein the chemical is a plurality of chemical pellets, wherein the chemical pellets have a diameter larger than an interior diameter of the holes.

18. The method of claim 17, wherein the chemical pellets are of two different diameters, a larger and smaller diameter, wherein the smaller diameter pellets dissolve to a smaller diameter size that is smaller than the interior diameter of the holes and pass through holes faster than the larger diameter pellets.

19. The method of claim 17, wherein the smaller diameter pellets have a different chemical composition than the larger diameter pellets.

* * * * *